US006267585B1

(12) United States Patent
Suttrop

(10) Patent No.: US 6,267,585 B1
(45) Date of Patent: Jul. 31, 2001

(54) METHOD AND COMBUSTOR FOR COMBUSTING HYDROGEN

(75) Inventor: Friedemann Suttrop, Aachen (DE)

(73) Assignee: DaimlerChrysler Aerospace Airbus GmbH, Hamburg (DE)

( * ) Notice: Subject to any disclaimer, the term of this patent is extended or adjusted under 35 U.S.C. 154(b) by 0 days.

(21) Appl. No.: 09/307,125

(22) Filed: May 7, 1999

Related U.S. Application Data

(63) Continuation-in-part of application No. 08/769,785, filed on Dec. 18, 1996, now abandoned.

(51) Int. Cl.[7] ..... F23D 14/12; F23D 14/10

(52) U.S. Cl. ..... 431/354; 431/8; 431/278; 431/285; 431/10; 431/328; 239/420; 239/424.5; 239/433; 239/434; 239/426

(58) Field of Search ..... 431/278, 354, 431/10, 8, 285, 326, 328; 126/39 E; 239/420, 421, 424, 424.5, 426, 432, 433, 434, 568, 562; 60/737, 739

(56) References Cited

U.S. PATENT DOCUMENTS

| | | | |
|---|---|---|---|
| 231,013 | 8/1880 | Crutchett . | |
| 1,539,093 | 5/1925 | Mettler . | |
| 1,971,208 | 8/1934 | Butz et al. . | |
| 2,497,476 | 2/1950 | Stadler . | |
| 2,601,242 | 6/1952 | Bonvillian et al. | 431/115 |
| 3,181,590 | 5/1965 | Dupler . | |
| 3,504,994 | 4/1970 | Desty et al. . | |
| 3,617,224 | 11/1971 | Brun-Tsekhovol . | |
| 3,724,994 * | 4/1973 | Desty . | |
| 3,870,459 | 3/1975 | Desty et al. . | |
| 4,100,733 | 7/1978 | Striebel et al. . | |
| 4,845,952 | 7/1989 | Beebe | 60/737 |
| 4,887,963 * | 12/1989 | Lemer . | |

FOREIGN PATENT DOCUMENTS

| | | | |
|---|---|---|---|
| 3902026 | 7/1989 | (DE) | 431/354 |
| 580500 * | 1/1994 | (EP) . | |
| 1246126 | 9/1971 | (GB) . | |
| 2250339 * | 6/1992 | (GB) . | |

OTHER PUBLICATIONS

John B. Heywood et al. Parameters Controlling Nitric Oxide Emissions from Gas Turbine Combustors, AGAR-D–CP–125, Neuilly sur Seine, France, Apr. 1973, pp. 21–1 to 21–16.

Ziemann et al. Low–$NO_x$ Combustors for Hydrogen Fulled Aero Engine, World Hydrogen Energy Conference, Stuttgart, Germany, Jun. 1996.

V.A. Sosounov et al. Experimental Turbofan using Liquid Hydrogen and Liquid Natural Gas as Fuel, Joint Propulsion Conference, Orlando, FL. USA, Jul. 1990, pp. 1 to 11.

F. Shum et al; Potential Use of Hydrogen in Air Propulsion; Final Report; Dec., 1996; pp. 101, 102, 104, 106, 109.

* cited by examiner

*Primary Examiner*—Carl D. Price
(74) *Attorney, Agent, or Firm*—W. F. Fasse; W. G. Fasse

(57) ABSTRACT

A plate burner for combusting hydrogen with air as an oxidizer forms a wall portion of a combustion chamber for example of a gas turbine. The plate burner is so constructed that air and hydrogen are separately guided to the downstream surface area facing into the combustion chamber for forming a large number of diffusive microcombustion flames, thus achieving a very low mixing scale simultaneously with a high nixing intensity. The number of diffusive micorcombustion flames is so selected that the $NO_x$ content in the exhaust gas from the combustion chamber is at the most $10\times10^{-6}$ cubic foot per cubic foot of exhaust gas. The hydrogen enters the entrance area into the combustion chamber either through a porous wall, and air is injected into the hydrogen environment to form inverse diffusive microcombustion flames or the hydrogen is injected through a multitude of fine holes into high velocity air jets forming regular diffusion flames. In both instances, the formation of $NO_x$ in the exhaust gas during combustion is reduced to the above level or below.

8 Claims, 6 Drawing Sheets

FIG. 6
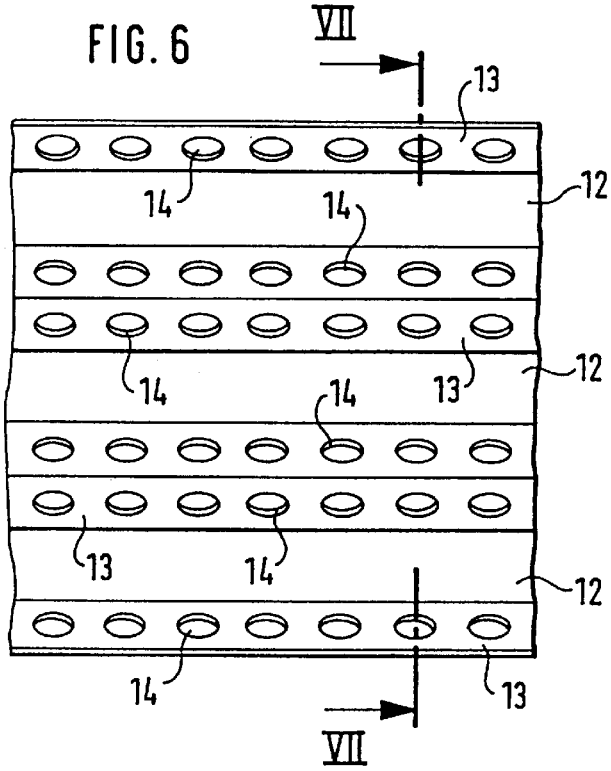
FIG. 7
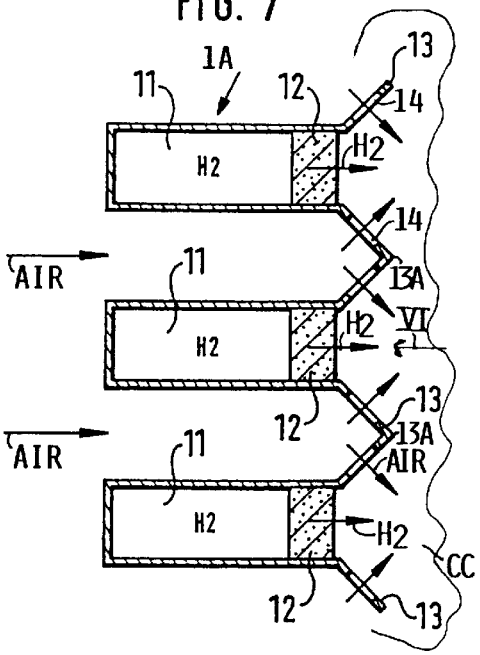
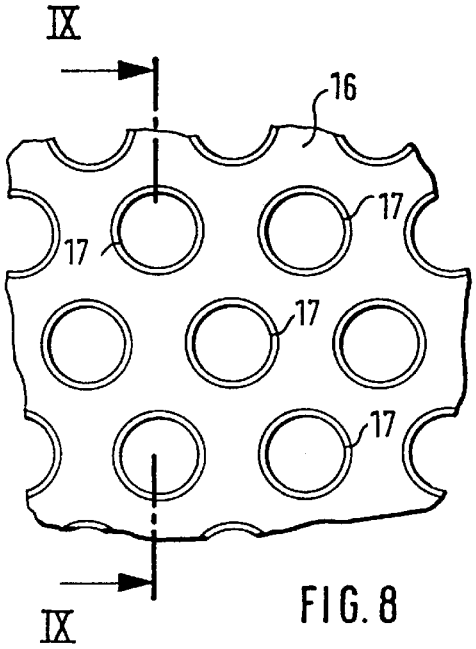
FIG. 8
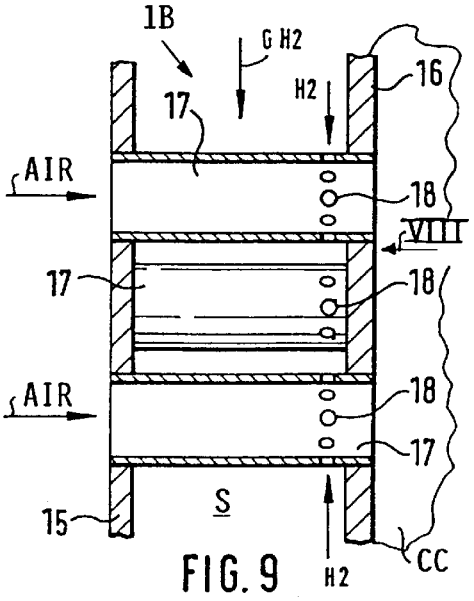
FIG. 9

METHOD AND COMBUSTOR FOR COMBUSTING HYDROGEN

CROSS-REFERENCE TO RELATED APPLICATION

This is a Continuation-In-Part application of my parent copending application U.S. Ser. No. 08/769,785; filed on Dec. 18, 1996, now abandoned. The priority of the parent case is claimed under 35 U.S.C. §120. The German priority date of Dec. 19, 1995 is claimed through the parent application under 35 U.S.C. §119.

FIELD OF THE INVENTION

The invention relates to a method and burner or combustor for combusting hydrogen by diffusion combustion using air as an oxidizer. This method and combustor are especially useful in connection with gas turbine combustion chambers in aircraft engines.

BACKGROUND INFORMATION

The use of hydrogen ($H_2$) as fuel for burners of all kinds, for example for combustors in combustion chambers of gas turbines, has the advantage of an especially high reactivity and thus an extraordinary large stability in the combustion. This stable combustion is achieved even if there is an excess air supply as is the case in the combustion chambers of gas turbines.

Publications relating to combustion techniques by Heywood and Mikus show that a reduction in the formation of nitrogen oxides ($NO_x$) can be achieved in combustion flames with a sufficiently high air excess if the mixing quality of air and fuel is increased. According to Heywood and Mikus, the $NO_x$ formation can be minimized by a completely homogeneous fuel-air mixture as can be attained, for example, by premixing of the fuel and air upstream of the combustion flame proper as viewed in the gas flow direction. A respective suggestion of a homogeneous premixing of the fuel and air supply with hydrogen as fuel, has been made by Pratt and Whitney of Canada. In spite of the advantages that are attained by the premixing with regard to the reduction of nitrogen oxides emissions in engine exhaust gases, there is a substantial drawback in such premixing in that flame flashbacks from the combustion chamber back into the premixing area can happen. Such flame flashbacks are very dangerous.

U.S. Pat. No. 4,100,733 (Striebel et al.) discloses a premix combustor with elaborate efforts to reduce "noxious contaminants" from engine exhaust gases. More specifically, a stable operation without flame flashbacks and the reduction of $NO_x$ are the goals of Striebel et al. This aim is achieved according to Striebel et al. by a plurality of primary tubes wherein fuel and air are premixed at low fuel flow rates and a plurality of secondary tubes for further mixing once a threshold fuel flow rate has been reached. Such stepwise premixing achieves a reasonably homogeneous fuel air mixture prior to entry into the combustion chamber and presumably flashbacks are avoided as long as low BTU fuels are used as is emphasized by Striebel et al. A substantial risk of flashbacks, however, cannot be avoided by the teachings of Striebel et al. if the fuel is hydrogen having very large flame velocities.

The above discussed first group of conventional burners or combustors which uses premixing of hydrogen and air generally requires burners of relatively simple construction. For example, a hydrogen distribution chamber having a plate configuration is inserted into the combustion chamber, whereby the hydrogen flows in a direction crosswise to an air flow direction. The air flow direction is referred to herein as the main or primary flow direction, while the hydrogen flow direction is referred to as the secondary flow direction. The hydrogen distribution chamber includes a multitude of air guide tubes extending in the main flow direction as shown by Striebel et al. Each tube has an inlet and an outlet opening for the air. Each air guide tube communicates through small bores or holes with the hydrogen distribution chamber. These bores or holes are positioned close to the inlet opening of the respective tube so that premixing can take place in each tube. If hydrogen is introduced into the hydrogen distribution chamber, it flows in the secondary flow direction crosswise to the primary flow direction toward the individual bores or holes in the tubes and thus can enter into the air guide tubes which function as premixing tubes. As air is passed through these air guide tubes hydrogen and air are mixed with each other within the air guide tubes before entry of the air fuel mixture into the combustion chamber. Such an arrangement of the hydrogen distribution chamber provides a substantially simplified structural configuration of the burner because individual ducts for the hydrogen to the individual air guide tubes or to the individual combustion zones are not needed.

A second group of hydrogen combustors that works without remixing of air and hydrogen recognizes the importance of the mixing degree for reducing the generation of $NO_x$ in the combustion of hydrogen. This second group of combustors uses diffusion combustion for which an increased number of hydrogen injection nozzles are required. Such nozzles are normally conventional vortex twist generating nozzles. Reference is made in this connection to TRUD by Kusnetzov, published in Russia, and to publications by Motoren-Und Turbinen-Union (MTU) of Munich, Germany. The Kusnetzov principle published in TRUD for example permits increasing the total number of combustion flames over the available burner surface area by a factor of 5 or larger compared to other conventional hydrogen burners. Thus, a combustion chamber conventionally with a given number of combustion flames, for example 30 such flames, can be modified to have 150 or more flames over the entire available burner surface area facing into the combustion chamber. Each of these individual combustion flames still has a diameter of about 20 mm. The TRUD or Kusnetzov system has its limitations in further increasing the number of hydrogen injection nozzles, because the increased number of combustion zones also requires increasing the number of individual hydrogen supply pipelines.

U.S. Pat. No. 3,504,994 (Desty et al.) and U.S. Pat. No. 3,870,459 (Desty et al.) disclose fluid fuel burners falling into the second group of burners using diffusion mixing. The air is supplied through a plurality of tubes which offer a low resistance to air flow making the Desty et al. system particularly suitable for use with natural draught. The fluid fuel is supplied through the gaps between the air supply tubes or through a layer of metal sponge positioned in the gaps between the tubes. Temperature variations cause expansions and contractions of the air tubes, whereby the flow cross-sectional dimensions of the gaps between the air tubes are not dimensionally stable. Hence, the fuel supply is not stable either.

There is room for improvement, especially with regard to the reduction of $NO_x$ in diffusion burners. The disclosure of U.S. Pat. No. 3,504,994 (Desty et al.) tries to improve the fuel air mixing by a baffle plate that has holes surrounding the outlet ends of the air supply tubes, whereby fuel flow ring gaps are formed that surround the air outlet ends of the tubes directly below the baffle plate. While the baffle plate may improve the mixing it will not necessarily improve the steadiness of the fuel supply. Similar considerations apply to an end plate with fuel exit holes which direct the fuel jets in parallel to the air jets, thereby neither improving the mixing nor the $NO_x$ reduction.

OBJECTS OF THE INVENTION

In view of the above it is the aim of the invention to achieve the following objects singly or in combination:

- to provide a method for a micromix diffusive combustion of hydrogen that can be practiced by generating a multitude of diffusive microcombustion flames formed in a burner for reducing the generation of $NO_x$ in engine exhaust gas by at least 80% to low levels of 20% or less of conventional $NO_x$ levels in burners of comparable size;
- to achieve a reduction in the formation of $NO_x$ to levels at or below $10\times10^{-6}$ cubic foot of NOx per cubic foot of exhaust gas produced by an engine operating with the present diffusive burner that avoids premising;
- to avoid the need for a large number of hydrogen supply pipes or ducts by feeding hydrogen to a multitude of diffusive microcombustion flames through one or only a few hydrogen supply ducts;
- to utilize the cooling capacity of the hydrogen to cool the combustion and combustion chamber;
- to miniaturize the diffusive combustion flames so that they are at least ten-fold smaller than conventional diffusive combustion flames in diffusion burners so that several thousand individual and distinct diffusion microcombustion flames may be formed in a combustion chamber;
- to cause an intensive air-hydrogen diffusive micromixing in a multitude of diffusive microcombustion flames without any premixing to thereby achieve a substantial reduction of the nitrogen oxide formation and emission while simultaneously achieving the advantage of avoiding flame flashbacks due to the use of diffusive combustors;
- to optimally increase the mixing intensity while minimizing the mixing scale by efficiently using as much as possible the pressure drop or pressure loss energy in a turbine combustor for enhancing the diffusive fuel air mixing by eddy transport in a multitude of diffusive microcombustion flames; and
- to rapidly disperse in the present combustor any stoichiometric high temperature spots or zones that tend to form in connection with diffusion flames and that are primarily responsible for gas phase NOx-production.

SUMMARY OF THE INVENTION

The above objects have been achieved by the present method and by the present combustor. More specifically, the present method for combusting hydrogen as fuel and air as an oxidizer in a combustor including fuel inlets and air inlets for diffusion combustion of said hydrogen and air in a combustion chamber having a burner surface area wherein exhaust gas containing nitrogen oxides $NO_x$ is produced during combustion, is performed by the following steps:

(a) feeding air jets in a first direction through said air inlets into said combustion chamber;

(b) feeding simultaneously hydrogen jets in a second direction through said hydrogen inlet through-holes into said combustion chamber, so that said first and second direction enclose a mixing angle;

(c) diffusively micromixing said hydrogen and air with each other in said combustion chamber to avoid premixing outside said combustion chamber, for generating a number of stable distinct diffusive microcombustion flames;

(d) sustaining said micromixing in each of said diffusive microcombustion flames in said combustion chamber by a turbulence intensity that depends on a pressure drop available in said combustion chamber for maintaining each of said diffusive microcombustion flames distinct from any other of said flames; and (e) selecting said mixing angle and said number of distinct and stable diffusive microcombustion flames per square inch of said burner surface area so that the formation of said nitrogen oxides $NO_x$ in said exhaust gas is at a level of $10\times10^{-6}$ cubic foot of $NO_x$ per cubic foot of said exhaust gases at the most during combustion as measured at atmospheric burner entrance conditions.

A combustor according to the invention combines the following features: a combustion chamber in which exhaust gas including nitrogen oxides $NO_x$ is produced during combustion, said combustor comprising a burner surface area facing into said combustion chamber (CC), a number of hydrogen fuel inlet through-holes in said combustor for feeding hydrogen jets into said combustion chamber, a plurality of air inlets in said combustor for feeding air jets into said combustion chamber, said fuel inlet through-holes and said air inlets being so positioned relative to each other and relative to said combustion chamber that a flow direction of said hydrogen jets and a flow direction of said air jets enclose a mixing angle for diffusive micromixing of hydrogen and air in said combustion chamber with a mixing intensity that depends on a pressure drop available in said combustion chamber for sustaining a number of distinct and stable diffusive microcombustion flames per square inch of said burner surface area, said number of flames in combination with said mixing angle maintaining said nitrogen oxides $NO_x$ at most at a level of $10\times10^{-6}$ cubic foot of $NO_x$ per cubic foot of said exhaust gases during combustion as measured at atmospheric burner entrance conditions and premixing outside said combustion chamber is avoided.

The invention selects a sufficiently large number of diffusive microcombustion flames and takes advantage of the pressure drop in the combustion chamber for achieving a small mixing scale in combination with a maximized or at least optimized mixing intensity as is explained in more detail below. Premixing is avoided according to the invention whereby flashback is prevented with certainty.

The miniaturization of the diffusive microcombustion flames and the increase of the number of such flames per square inch of burner surface area as taught by the invention achieves an advantageously small mixing scale simultaneously with an increased mixing intensity. The term "mixing scale" as used herein corresponds to the "scale of turbulence" used in connection with turbulent flows. A large mixing scale defines, for instance, rough non-uniformities of concentrations of mixing species which need long times to be homogenized in the dissipation process of the available turbulence energy. Therefore, an a priori small scale fuel distribution combined with high energetic intensity of micro turbulent eddies is best for the purposes of the invention. The small scale fuel distribution is, according to the invention, achieved by choosing a sufficiently large number of microcombustion flames, whereas the high energetic intensity of turbulence is gained by making best use of the available combustion chamber pressure drop, when the pressure loss energy is utilized for accelerating the air or the fuel into the diffusive microcombustion flames. More specifically, the high kinetic energy of the air or fuel jets converts to turbulence energy as the air jets or fuel jets resolve into turbulence. A strong turbulence in turn accelerates the mixing intensity by eddy transport. A rapid micromixing and homogenization of the air fuel mixture in the diffusive microcombustion flames makes sure that stoichiometric high temperature zones are rapidly dispersed before they can become harmful. Such stoichiometric high temperature zones are unavoidable in diffusion flames but have been effectively rendered harmless by the invention. The rapid dispersion of the high temperature zones is important because it reduces the formation of $NO_x$ which tends to be formed primarily in these high temperature zones where oxygen and nitrogen combine. Thus, the reduction of the mixing scale in combination with an optimally increased mixing intensity are important features of the invention because a small mixing scale in combination with a large mixing intensity assure the reduction of $NO_x$ to levels not attainable heretofore in the exhaust gases of gas turbine engines, particularly aircraft engines which are operated by combusting hydrogen. The term "mixing intensity", as stated above, defines the rate of homogenization of the air/fuel mixture, which strongly depends on the "turbulence intensity" as a measure of energy contained in the turbulence of the present diffusive microcombustion flames.

The foregoing features of the invention have certain advantages, in addition to the unexpected $NO_x$ reduction down to levels of 20% or less of comparable engines equipped with conventional combustors. These additional advantages of the invention are seen in that the production and technological effort and expense of the present combustors is small since the formation of a large number of diffusive microcombustion flames without a respective number of hydrogen supply tubes is simple. Still another advantage of the invention is seen in that the supply of hydrogen can be used as a cooling medium, especially prior to its distribution into a multitude of diffusive microcombustion flames. Moreover, the invention has succeeded in retaining in the present diffusive micromixing the advantage of avoiding flame flashbacks, which is inherent in diffusive combustion systems, while simultaneously reducing the $NO_x$ formation in the exhaust gas. Such reduction cannot be achieved by conventional diffusive large scale mixing.

BRIEF DESCRIPTION OF THE DRAWINGS

In order that the invention may be clearly understood, it will now be described, by way of example, with reference to the accompanying drawings, wherein:

FIG. 6 shows a view in the direction of the arrow VI in FIG. 7, illustrating air distribution ridges with air flow holes and wall sections of porous material for hydrogen distribution;

FIG. 7 is a sectional view along section line VII—VII in FIG. 6;

FIG. 8 is a view similar to that of FIG. 1, but showing a view in the direction of the arrow VIII in FIG. 9;

FIG. 9 is a sectional view along section line IX—IX in FIG. 8 illustrating hydrogen distribution holes at the exit end of air distribution tubes;

DETAILED DESCRIPTION OF PREFERRED EXAMPLE EMBODIMENTS AND OF THE BEST MODE OF THE INVENTION

Figure 24:
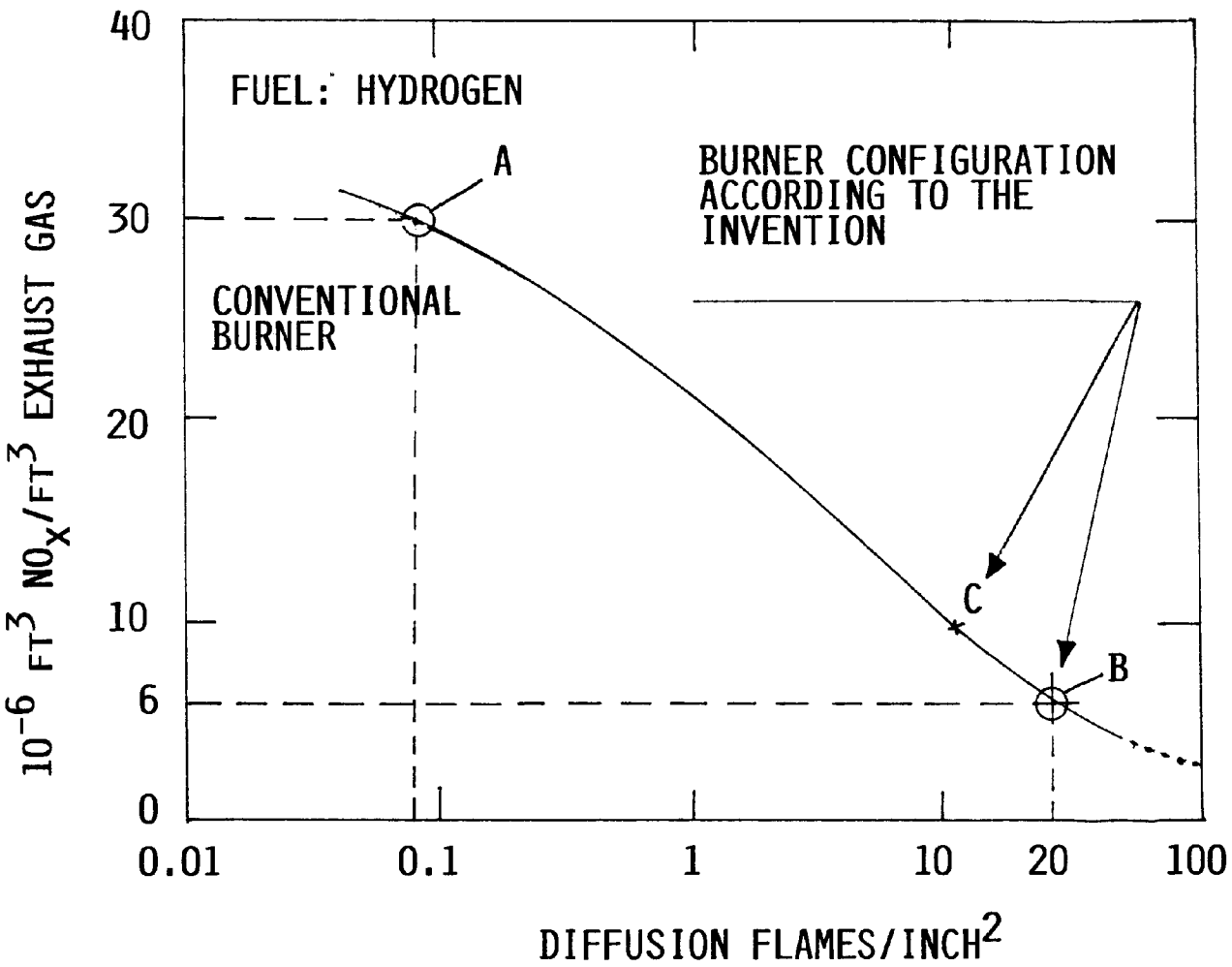
FIG. 24 is a diagram showing the $NO_x$ reduction in cubic foot$\cdot 10^{-6}$ of $NO_x$ per cubic foot of exhaust gas as a function of the number of diffusive microcombustion flames per square inch of combustor surface area facing into the combustion chamber.

The invention will first be explained with reference to FIG. 24 which illustrates test results performed with a gas turbine engine model A 320 APUGTCP 36–300. FIG. 24 shows the content of $NO_x$ in cubic foot$\times 10^{-6}$ per cubic foot of exhaust gas as a function of the flame density per square inch of the combustor surface facing into the combustion chamber. The tests were made under atmospheric conditions which means that the absolute Nox levels measured in the tests are based on atmospheric burner entrance conditions. The combustor had a surface area of 67.9 square inches facing into the combustion chamber. In its original conventional form the combustor had six air injection nozzles distributed over the combustor surface providing 0.088 diffusion flames per square inch. Tests were run with the conventional combustor using hydrogen fuel in one test and kerosene fuel in another test. The $NO_x$ content in the exhaust gas was the same for both fuels, namely as shown at point A in FIG. 24 showing $30\times 10^{-6}$ cubic foot of $NO_x$ per one cubic foot of exhaust gas for 0.088 diffusion combustion flames per square inch of burner surface.

A further test was made with the same engine, however, with a combustor modified as taught by the invention. The modified combustor had a total of 1600 micromix air jets and a corresponding number of diffusive microcombustion flames which amounts to approximately 24 diffusive microcombustion flames per square inch of combustor surface facing into the combustion chamber, (1600:67.9). Point B in FIG. 24 was obtained by repeating the test with hydrogen as fuel and air as oxidizer. Point B represents the invention and evidences a substantial reduction in the $NO_x$ content of the exhaust gas, compared to point A, namely about $6\times 10^{-6}$ cubic foot of $NO_x$ per cubic foot of exhaust gas compared to $30\times 10^{-6}$ cubic foot of $NO_x$ per cubic foot of exhaust gas for point A. This result shows an eighty percent reduction in the $NO_x$ production by the invention compared to the prior art as represented by the tested engine A320 APUGTCP 36–300 prior to the replacement of its original combustor by a combustor as taught by the invention. FIG. 24 also shows at point C that for ten diffusive microcombustion flames per square inch of burner surface the $No_x$ production is still much reduced, namely $10\times 10^{-6}$ cubic foot of $No_x$ per cubic foot of the exhaust gas or only one third of the $No_x$ volume produced in the comparative conventional combustor.

FIGS. 1 to 7 illustrate combustor configurations in which a substantial number of micromix air jets, at least 10 per square inch of burner surface, is injected into a hydrogen environment in a combustion chamber CC for generating a corresponding number of diffusive microcombustion flames for an inverted diffusive combustion.

Figure 1:
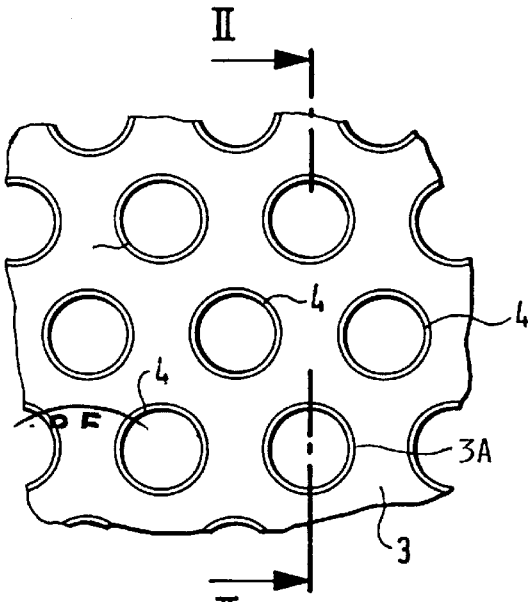
FIG. 1 shows a plan view of a portion of a combustor as viewed in the direction of the arrow I in FIG. 2, illustrating a matrix construction of a combustor that forms a back wall for a combustion chamber.
Figure 2:
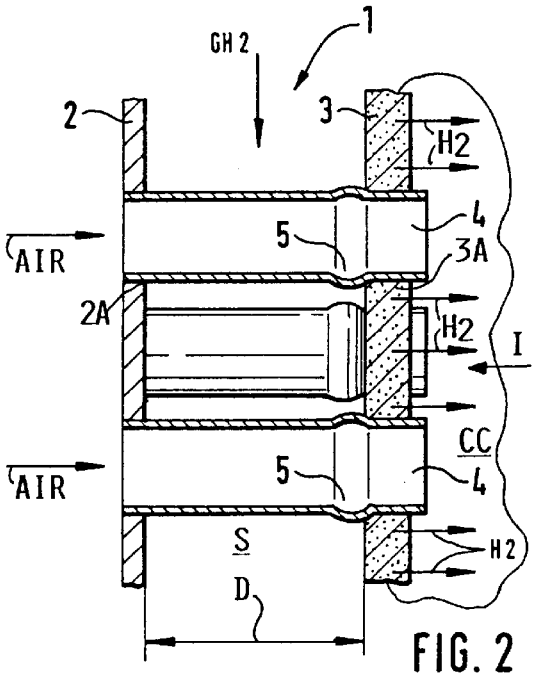
FIG. 2 shows a sectional view along section line II—II in FIG. 1, wherein a porous combustor wall functions as a micromix hydrogen distributor.

FIGS. 1 to 4 show a combustor 1 with a surface area facing into the combustion chamber CC for the combustion of hydrogen. This surface area is available for the positioning of diffusive microcombustion flames. The combustion chamber CC is, for example, a part of a gas turbine. The combustor 1 has the configuration of a double walled plate forming the rear wall of the combustion chamber CC. A primary air flow marked by arrows "AIR" extends perpendicularly to the combustor surface area. Further details of the combustion chamber and its housing are not shown since the combustion chamber may be of any desired conventional construction. The combustor 1 comprises a first perforated plate 2 with first perforations 2A and a second perforated plate 3 with second perforations 3A. The two perforated plates 2 and 3 are interconnected by respective air guide tubes 4 which keep the plates 2 and 3 at a constant distance D from each other to enclose a hydrogen distribution space S. The perforations 2A and 3A may be arranged in accordance with any desired pattern. The perforations 2A are, however, axially aligned with the perforations 3A to hold the tubes 4 as shown in FIG. 2.

The perforated plate 2 is, for example, made of a suitable heat resistant metal that is not gas permeable. The second perforated plate 3 is constructed according to the invention of a gas permeable material such as a porous material, for example a sinter metal which will finely disperse the hydrogen. Other suitable materials are porous ceramics, metal fiber materials, other heat resistant porous materials and heat resistant perforated materials such as perforated sheet metal.

While the apertures 2A and 3A may be arranged in any desired pattern, the pattern must be the same in both plates 2 and 3 so that the apertures register with each other to form pairs of apertures 2A, 3A. The double-walled plate construction is achieved by interconnecting the plates 2 and 3 through the tubes 4 which serve as spacers, plate interconnectors and air guides to form a large number of micromix air jets. This number of micromix air jets is large enough if a substantial reduction of nitrogen oxides in the exhaust gas is achieved, e.g. down to at least 20% or less of the $NO_x$ production in conventional burners of the same size but with a conventional, small number of large combustion flames. The plate 2 is, for example, soldered or welded or otherwise bonded to the left-hand ends of the tubes 4 in the apertures 2A. The right-hand air exit ends of the tubes 4 are preferably provided with beaded radially outwardly bulging rings 5 against which the second plate 3 rests with a location fit between each tube and the plate 3. The bulge 5 may be formed by a flanging or crimping operation of the tubes 4. The resulting location fit makes sure that a dimensionally stable double-walled plate structure is obtained that encloses a hydrogen distribution space S. The hydrogen is in its gaseous form shown symbolically by an arrow GH2. The tube walls are closed along their entire length through the space S to prevent entry of hydrogen into the tubes, and to prevent premixing in the tubes.

Figure 3:
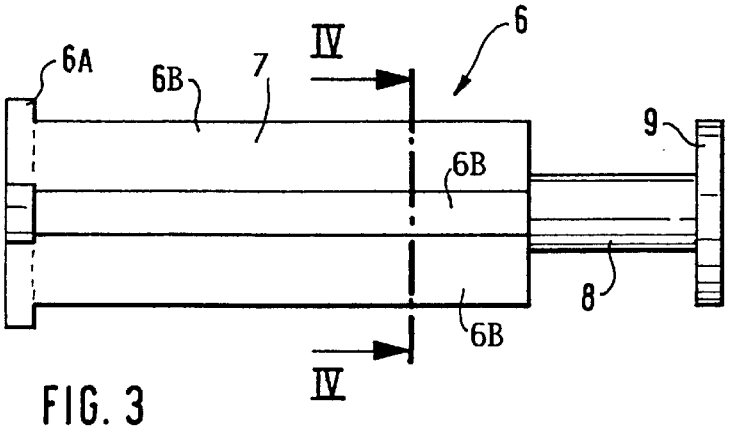
FIG. 3 shows a side view of an air guide pin functioning as an air distributor in the burner of FIGS. 1 and 2.
Figure 4:
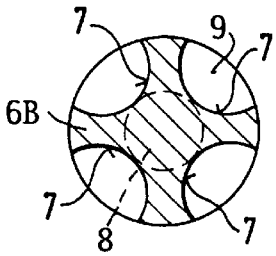
FIG. 4 is a sectional view in the direction of the arrows IV—IV in FIG. 3 through the air guide pin.

According to the invention an air distribution and guide pin 6 shown on an enlarged scale in FIGS. 3 and 4 is preferably inserted into each tube 4. Each pin 6 comprises a central stem 8 surrounded by axial flutes 7 spaced by axial lands 6B. In the shown example there are four flutes 7 and four lands 6B. The flutes and lands surround most of the length of the stem 8, however, a portion of the stem has a reduced diameter compared to the diameter of the lands 6B and carries at its right-hand end a flange or disk 9 for guiding and deflecting micromix air jets as these jets emerge from the flutes 7 directly into the combustion chamber. The outer diameter of the flange 9 corresponds approximately to the diameter of the lands 6B. At the opposite end, the pin 6 carries stops 6A axially aligned with the lands 6B. These stops 6A are short in the axial direction, but have an outer diameter larger than the lands 6B for resting against the outer surface of the wall 2. These pins 6 may be made as solid elements as shown. The pins may be replaced by axially short sheet metal disks with or without an axial stem extension as will be described below with reference to FIG. 14.

Figure 5:
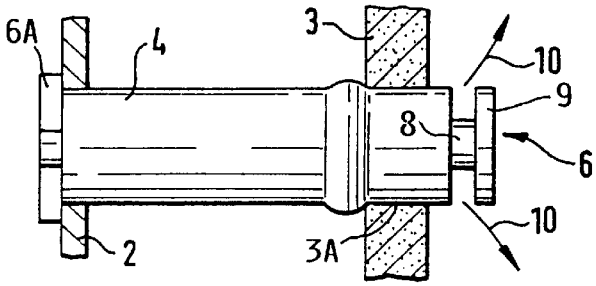
FIG. 5 is a side view partially in section showing the air guide pin inserted into an air guide tube of FIG. 2.

FIG. 5 shows an example of the air distribution and guide pin 6 inserted into a tube 4. For this purpose the flange 9 and the lands 6B have an outer diameter providing a sliding fit into the inner diameter of the tube 4. The insertion takes place in the direction of the air flow from left to right and the stops 6A bear against the plate 2 when the guide pin 6 is fully inserted. The just described insertion and selection of diameters holds the guide pins 6 firmly and permanently in the tubes 4. The assembly shown in FIG. 5 forms an air injector and a multitude of such injectors are mounted as shown in FIG. 2 so that each tube 4 has its own injector, whereby the air is distributed as shown by arrows 10 in FIG. 5 in the form of a large number of diffusive turbulent micromix air jets 10. Each pin 6 forms for example four micromix air jets since each pin 6 has four air flow flutes 7, whereby four diffusive microcombustion flames are formed by each pin 6. The total number of micromix air jets is so selected that according to the invention there are at least ten, preferably at least twenty diffusive microcombustion flames per square inch of the burner surface area facing into the combustion chamber CC. Due to the deflection by the disks 9 and as shown in FIG. 5, the air flow direction of the air jets 10 extends at about 45° relative to the hydrogen flow direction shown in FIG. 2.

For operating the combustor 1 gaseous hydrogen shown by arrow $GH_2$ is introduced into the space S between the walls 2 and 3 perpendicularly to the air flow which is blown simultaneously through the tubes 4 into the combustion chamber CC. The porous wall 3 diffuses the hydrogen as shown by the horizontal arrows $H_2$ in a very fine distribution, thereby forming a hydrogen environment in which the hydrogen is uniformly distributed. The air blown into the combustion chamber is distributed in the form of a conical mantle shown by arrows 10 in FIG. 5 due to the position of the disk 9. However, the conical mantle is divided into four sectors by the four lands 6B, whereby four distinct diffusive microcombustion flames are generated per tube 4 that together have a rotational symmetry relative to the central longitudinal axes through each of the tubes 4. In any event, the number of diffusive microcombustion flames is selected as has been explained above with reference to FIG. 24.

The activation of the air hydrogen micromixing process is enhanced by the interaction of neighboring conical flame sectors that impinge on each other. The geometry of the guide pins 6 is so selected that with the insertion of the pins 6 into the tubes 4 until the stops 6A engage the plate 2, a predetermined air deflection pattern is achieved which results in a predetermined flame configuration for each individual diffusive microcombustion flame in the combustion chamber. In this connection it is quite possible to omit the stops 6A altogether to reduce weight. In that case the guide pins 6 will be inserted into the air guide tubes 4 with the help of an assembly jig so that each pin is inserted to the correct extent. Due to the present simple construction of the air injectors the injectors can be miniaturized and mass produced, whereby a substantially larger number of such injectors can be installed for each combustion chamber than was possible heretofore. Due to the miniaturization which results in diffusive microcombustion flames each of which has a diameter of about 2 mm.

FIGS. 6 and 7 illustrate another embodiment of a combustor 1A according to the invention for the injection of air jets into a hydrogen environment. The combustor 1A comprises several elongated individual hydrogen distribution channels 11 each having a U-shaped cross-section with one channel side closed by a porous wall 12, for example, made of sinter metal or the like for passing hydrogen through the walls 12. The length of the channels 11 extends perpendicularly to the drawing plane. The channels 11 are interconnected with each other by wall sections 13 provided with a multitude of holes 14 for dividing the air flow indicated by the arrow AIR into a large number of distinct micromix air jets which in turn form a respective or corresponding number of also distinct diffusive microcombustion flames in the combustion chamber CC without any premixing. The sections 13 are preferably perforated angular stock, or may be extensions of the walls of the channels 11 to form ridges 13A, e.g. by welding or soldering. Heat resistant sheet metal is suitable for making the channels 11 and the perforated wall sections 13. The angular stock sections 13 and sections formed as channel extension sections are equally suitable for connecting channels 11 to each other. The free longitudinal edges of the angular stock sections 13 are connected to respective longitudinal edges of the U-shaped hydrogen distribution channels 11, for example by welding, heat resistant brazing, or the like, so that one angular stock section 13 interconnects two neighboring channels 11. Each slanted wall of section 13 has the holes 14 uniformly spaced from one another in the longitudinal direction as best seen in FIG. 6. The number of distinct micromix air jets is sufficient if the production of $NO_x$ is reduced as taught herein.

The wall sections 13 as shown are slanted so that the primary air flow direction of the micromix air jets extends at about 45° across the direction of the hydrogen flow direction indicated by the arrows $H_2$. However, the sections 13 may have alternatively a square sectional configuration, whereby air through the holes 14 would travel at right angles or a mixing angle of 90° to the hydrogen flow direction $H_2$. A domed configuration of the sections 13 may be feasible instead of the angled or squared sectional configuration as long as the intended high mixing intensity is achieved in the diffusive microcombustion flames.

In order to operate the burner 1A, gaseous hydrogen $H_2$ is introduced into the distribution channels 11 while simultaneously blowing air through the holes 14 into the combustion chamber CC. The hydrogen flows inside the distribution channels 11 crosswise to the primary air flow direction and a fine hydrogen distribution or diffusion takes place through the porous wall 12 to form a hydrogen environment in the combustion chamber CC. Due to the air injection into the hydrogen environment a mixing zone is sustained in the area of each hole or bore 14 and each zone forms its own distinct diffusive microcombustion flame, whereby excessively high temperature zones are prevented or quickly dispersed and the $NO_x$ formation is correspondingly reduced.

The burner 1A of FIG. 7 has an especially simple construction that can be bent out of sheet metal to form the shown U-shaped channel cross-section. Each U-leg is preferably integrally connected with an angular section 13 that is already perforated with the holes 14. Thereafter, the U-channels are closed by the porous wall sections 12 and the individual sections are welded to each other along the ridges 13A of two neighboring perforated sections forming the angular sections 13. The burner 1A can be miniaturized to such an extent that several thousand diffusive microcombustion flames can be formed on the surface of the burner facing into the combustion chamber CC.

In the burners 1 and 1A described above, a fine distribution of hydrogen is achieved by porous walls 3 or 12 by introducing hydrogen either through the distribution space S or through the distribution channels 11. In operation the hydrogen is supplied to thousands of distinct diffusive microcombustion flames, whereby a micromix diffusion combustion of the hydrogen takes place. The present burners or combustors of FIGS. 1 to 7 form a hydrogen environment within the combustion chamber CC. The injection of a large number of air jets into this hydrogen environment results in an inverse diffusion combustion which is capable of stabilizing itself with a turbulent flow characteristic in the resulting diffusive microcombustion flames. The essential advantage of this inverse hydrogen diffusion combustion of the invention resides in that the hydrogen is efficiently used for cooling the structure of the combustor including the tubes 4 of the rear wall forming the burner of the combustion chamber CC while substantially reducing the formation of nitrogen oxides compared to conventional burners as has been explained above with reference to FIG. 24.

Instead of using porous sinter metals for making the plate 3 and the wall sections 12 of the above described combustors 1, 1A these elements 3 and 12 can be made by using other porous materials such as porous metal fibers, for example "felt metal" can be used for the present purposes. Furthermore, porous ceramic materials can be used for the plate 3 and the wall sections 12. In order to limit any effects that may occur due to the fact that the pores in a porous material are inhomogeneously distributed, it is suggested that a perforated sheet metal with a very fine uniform hole distribution is arranged in series with a relatively thin layer of a porous material. Alternatively, it is possible to entirely replace the porous material walls by a thin sheet material provided with a multitude of fine diameter holes. The pore size and or the hole diameter for the passage of hydrogen must be such, that sufficient hydrogen is provided to sustain the combustion in the large number of diffusive microcombustion flames.

FIGS. 8 to 17 show a further combustor 1B according to the invention working on the basis of regular micromix diffusion combustion rather than on the basis of an inverse diffusion as in FIGS. 1 to 7. In FIGS. 8 to 19 hydrogen is injected into a high velocity air environment.

The burner 1B comprises, as the other embodiments, two perforated plates 15 and 16 spaced from each other by tubes 17 mounted in the perforations for a hydrogen fuel distribution perpendicularly to a primary flow direction. Each tube 17 has an air inlet port and an air outlet port directly into the combustion chamber CC. Hydrogen fuel enters the diffusive microcombustion zones through holes 18 passing through the walls of each tube 17 as close as possible to the exit port of each tube next to the combustion chamber CC. The holes 18 are preferably uniformly distributed around the circumference of each tube 17 with equal angular on-center spacings from one hole 18 to the next hole 18. As shown in FIG. 9, the cross-sectional flow area of the holes 18 is smaller than the cross-sectional flow area of the tubes 17 and the flow direction of distinct hydrogen jets shown by arrows $H_2$ is at a right angle to the air flow direction through the tubes 17.

As shown in FIGS. 10 to 13, an air distribution and guide pin 19 is preferably inserted into each tube 17. Each pin 19 comprises a plurality of air guide lands 21 spaced by air guide flutes 23 around a stem 19A. Each air guide flute 23 extends axially between two air guide lands 21 of the pin 19, but not along a stem extension of the stem 19A. The stem extension forms a reduced diameter free flow guide surface 22.

Figure 14:
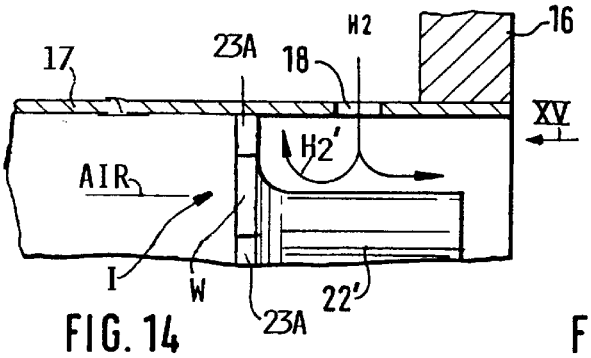
FIG. 14 is a view similar to that of FIG. 13, however showing an air distribution flat insert instead of an air guide pin, furthermore, the insert is shown axially displaced relative to the pin position of FIG. 13.
Figure 15:
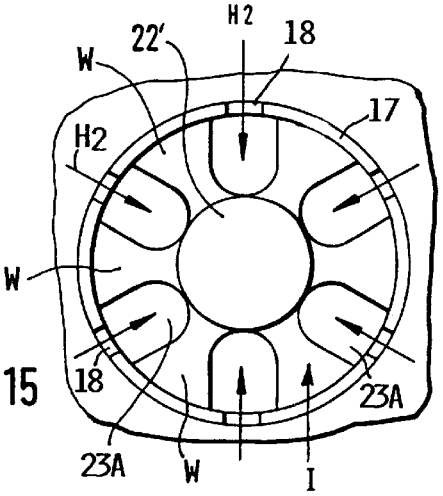
FIG. 15 is a view substantially in the direction of the arrow XV in FIG. 14, showing an angular position of the air distribution insert equal to FIG. 11.

The air guide pins 19 may be replaced by sheet metal inserts I which have orifices 23A which function as air distributors as shown in FIGS. 14 and 15 described in more detail below.

Figure 10:
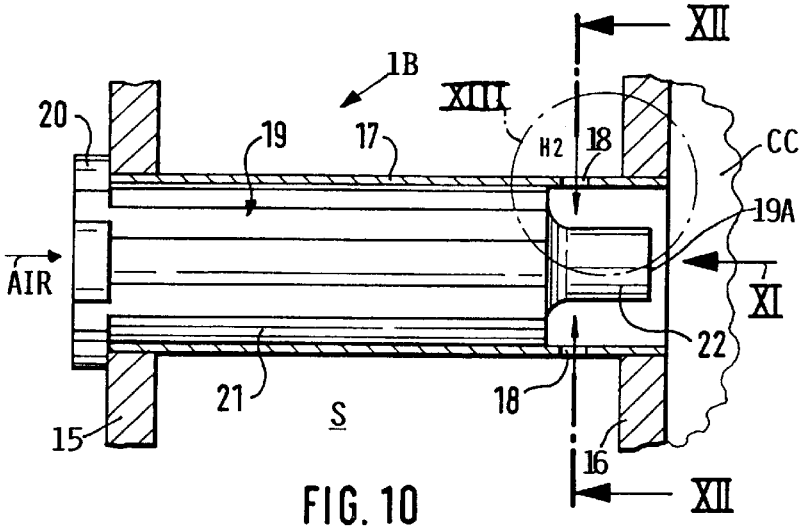
FIG. 10 is a side view partially in section, illustrating an air guide pin inserted into a tube with hydrogen distribution holes as shown in FIG. 9.
Figure 13:
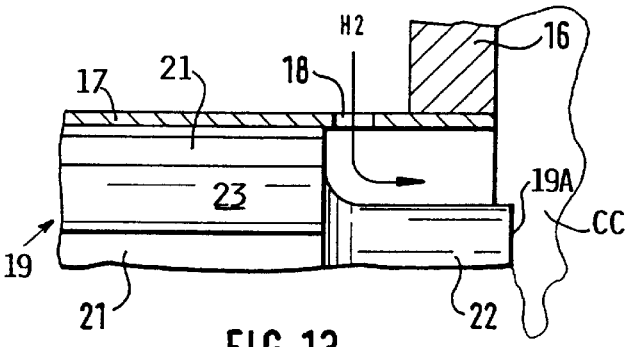
FIG. 13 shows the detail XIII in FIG. 10 on an enlarged scale, here again the air guide pin is rotated by 30 degrees, as in FIG. 12.

The free flow guide surface 22 cooperates with the holes 18 in guiding the air and hydrogen flow. At its other end opposite the free flow guide surface 22 the pin 19 carries stop elements 20 that bear against the wall 15 of the combustor 1B to limit the insertion depth. The radial depth of the flutes or grooves 23 reaches preferably to the diameter of the stem extension providing the free flow guide surface 22. However, the flute depth may be slightly less than the stem diameter, whereby a smooth curved transition gusset is formed between the end of a land 21 and the reduced diameter stem extension as seen in FIGS. 10 and 13. The number of flutes 23 corresponds to the number of holes 18 in the respective tubes 17 so that each hydrogen jet through the holes 18 is injected into its corresponding airstream, whereby in operation for example six diffusive microcombustion flames are formed by each guide pin 19 having six lands 21 and six flutes 23 cooperating with six holes 18 in the wall of the respective tube 17 for the injection of hydrogen jets $H_2$ into six micromix air streams at a 90° angle to the air flow direction.

In order to operate the burner or combustor 1B a large number of micromix air jets is blown through the tubes 17, more specifically through the flutes 23 of the air guide pins 19 from left to right into the combustion chamber CC. Simultaneously, hydrogen is introduced into the space S in the direction substantially perpendicularly to the air flow direction as indicated by the arrow $GH_2$ in FIG. 9. As the hydrogen passes through the holes 18 next to the combustion chamber, the hydrogen jets are entrained by the airstreams through the respective flutes 23 and move with the airstreams into the combustion chamber CC whereby the micromix air jets sustain a turbulent micromix diffusion flow and the production of $NO_x$ in the exhaust gas of the combustion chamber CC is reduced as described above. A diffusive microcombustion flame is formed downstream of each of the multitude of holes 18. Once ignition has occurred, these diffusive microcombustion flames are stabilized and remain distinct flames.

Since each tube 17 comprises, for example, six holes 18, and assuming the burner 1B comprises 500 tubes 17, a total of 6×500=3000 diffusive microcombustion flames are formed when operating the combustion chamber. Such a structure provides a substantial increase in the number of diffusive microcombustion flames compared to conventional burners. Application of the present teaching of the invention to the above mentioned combustor as published in TRUD would increase the number of installable combustion zones by a factor of about 40. This large number of diffusive microcombustion flames reduces the $NO_x$ production to less than 20% of the $NO_x$ production in a conventional burner of comparable size but with few large combustion flames.

The teaching of the invention results in all embodiments in a high degree of micromixing of the air with the hydrogen without any premixing, and with a substantially reduced mixing scale compared to conventional combustors. As a result, the generation of nitrogen oxide is reduced to a surprising extent, see FIG. 24. It is possible to adjust the present burner with regard to the air introduction by rotating the air guide pins 19 in the respective tubes 17 to thereby achieve different mixing ratios in the burner 1B. The stops 20 may, however, be omitted. In that case, the extent of the axial insertion of the guide pins 19 into the tubes 17 will be determined by a mounting jig at the time of manufacturing and assembly.

Figure 11:
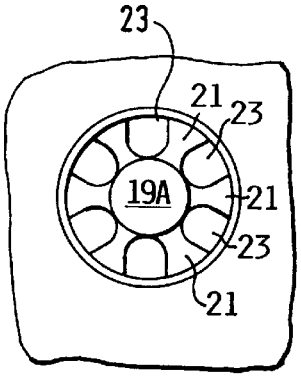
FIG. 11 is a view in the direction of the arrow XI in FIG. 10.
Figure 12:
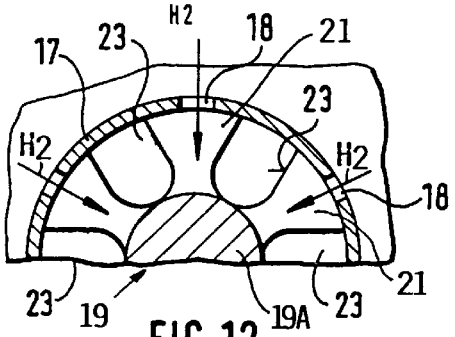
FIG. 12 is a sectional view along section line XII—XII in FIG. 10, this time after a 30-degree angular rotation of the air guide pin.

FIGS. 10 to 13 show different rotational adjustments of the guide pin 19 in the tube 17. In FIGS. 10 and 11 the air guide flutes 23 are aligned with the hydrogen supply holes 18. In FIGS. 12 and 13 the lands 21 of the guide pins 19 are aligned with the holes 18 in the tubes 17 but stop short of covering the holes 18 between air streams through the flutes 23. FIG. 13 also shows the guide pin 19 inserted axially into its tube 17 to such an extent that the land 21 reaches with its right-hand end almost to the respective hole 18. As a result, the hydrogen jet $H_2$ can be diverted only into the combustion chamber CC along the air guide surface 22 of the extension of the stem 19A. However, if the axial length of the lands 21 of the guide pins 19 is shorter or sheet metal inserts I are inserted to a lesser axial extent as shown in FIG. 14, the hydrogen jet $H_2$ passing through the holes 18 will be divided. A hydrogen portion $H_2'$ will flow in a countercurrent direction relative to the air flow, whereby a certain recirculation is generated that further improves the mixing of air and hydrogen directly next to the combustion chamber CC. These FIGS. are shown on an enlarged scale.

FIGS. 14 and 15 show an embodiment with heat resistant sheet metal air guide inserts I having a head plate with webs W between air guide orifices 23A. The head plate with its webs W may be secured to a stem 22' that serves the same purpose as the air guide surface 22 in FIGS. 10 and 13. However, the stem 22' may be omitted, whereby the air guide insert I would be just a disc with webs W and orifices 23A. Air jets passing through the air guide orifices 23A flow directly past the holes 18, whereby the hydrogen jets $H_2$, $H_2'$ impinge on the air jets at a right angle for an excellent mixing. However, the hydrogen jets may be directed to impinge on the air streams at an angle other than a right angle, for example by directing the holes 18 at a respective angle through the wall of the respective tube 17. In all of the just described embodiments, a fine diffusive micromixing of the hydrogen jets passing through the holes 18 into the air streams is assured so that a micromix diffusive combustion is obtained. The individual diffusive microcombustion flames will have a diameter of only about 2 mm each. In this type of micromixing of air and hydrogen the individual diffusive microcombustion flames stabilize themselves, frequently directly at the holes 18. By stabilizing themselves the diffusive microcombustion flames remain distinct. As mentioned above, the air guide stem 22' could be omitted, especially where the air guide orifices 23A are directly aligned with the holes 18 as shown in FIG. 15. In all embodiments shown in FIGS. 9 to 15 the hydrogen jets enter the airstream at an angle of 90 degrees for an efficient mixing.

Figure 16:
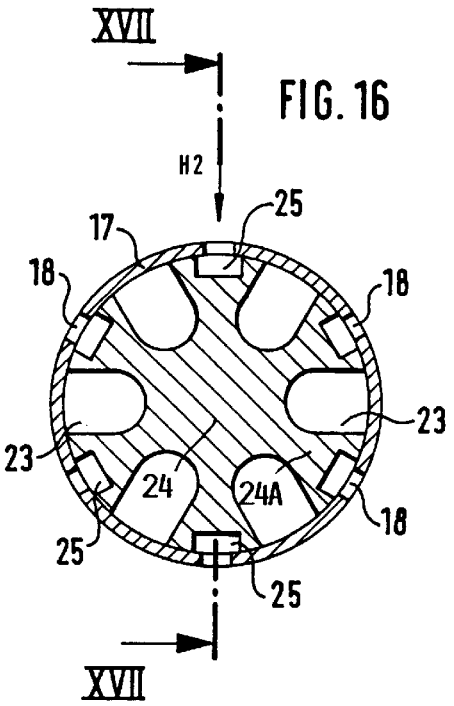
FIG. 16 is a sectional view along section line XVI—XVI in FIG. 17, illustrating a modified air guide pin construction with a plurality of air guide channels and with a plurality of hydrogen guide channels.
Figure 17:
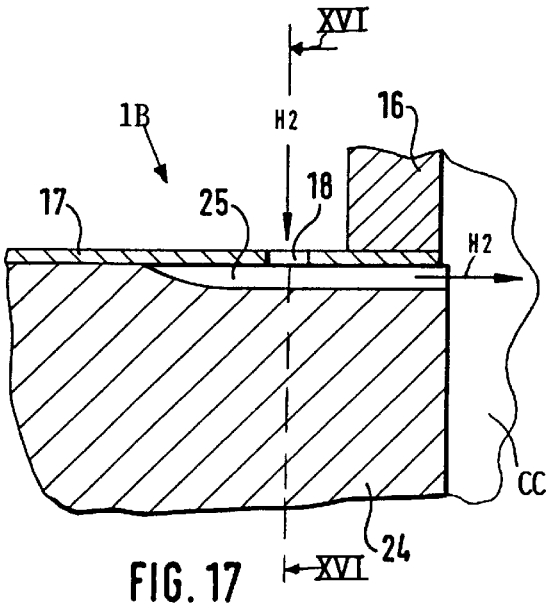
FIG. 17 is a sectional view along section line XVII—XVII in FIG. 16.

FIGS. 16 and 17 show a further modification of an air guide pin 24 in the present burner lB, whereby the hydrogen jets and the air jets are guided separately until they enter into the combustion chamber CC. In this embodiment the tubes 17 are also provided with holes 18 at their exit end next to the combustion chamber as described above. These tubes 17 are held between mounting plates 15 and 16 as described. The air guide pin 24, however, is provided with air guide flutes 23 and separate hydrogen guide channels 25 at the discharge end of the guide pin 24 next to the combustion chamber CC. The hydrogen guide channels 25 are formed in the lands 24A at the ends thereof between the flutes 23. The hydrogen guide channels 25 extend axially in parallel to the flutes 23. The air guide pins 24 are inserted into the tubes 17 so that each hole 18 leads into the respective hydrogen guide channel 25. As a result, hydrogen is diffused into the air in an area downstream of the wall 16 in the combustion chamber CC. This feature has the advantage that the generation of a multitude of diffusive microcombustion flames takes place inside the combustion chamber CC, whereby excessive thermal loads on the structural components especially of the burner itself are further reduced. The diffusive microcombustion flames stabilize themselves at the exit ports of the hydrogen guide channels 25.

Figure 18:
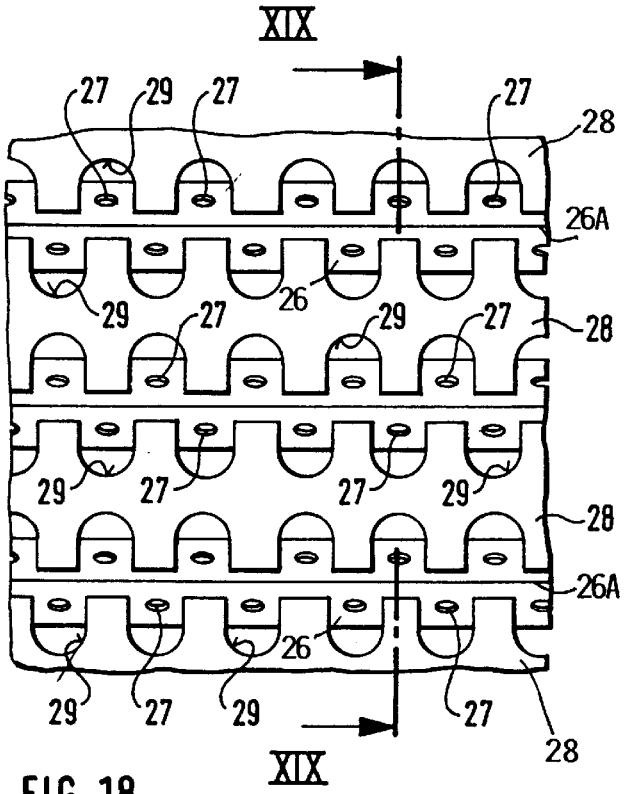
FIG. 18 is a view in the direction of the arrow XVIII in FIG. 19, illustrating another embodiment of the present hydrogen burner with hydrogen distribution channels each having a multitude of hydrogen distribution holes.
Figure 19:
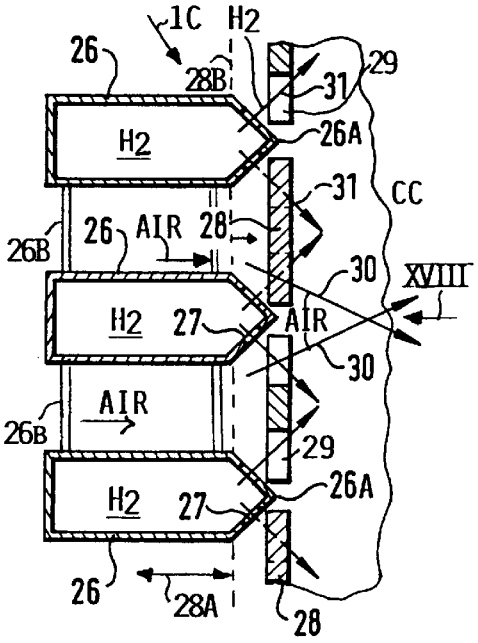
FIG. 19 is a sectional view along section line XIX—XIX in FIG. 18.

FIGS. 18 and 19 show a further embodiment of a burner or combustor 1C according to the invention for generating a regular diffusion combustion, wherein hydrogen is injected into high velocity air streams. The burner 1C is a relatively flat structure formed to have hydrogen guide channels 26 held together by spacer members 26B to form between the channels 26 air flow passages through which air can freely flow. Each channel 26 has a substantially rectangular or U-shaped cross-section except for an end section forming for example a roof with a ridge 26A with hydrogen exit through-holes 27 through both sides of the roof ridge 26A. Thus, the channels 26 have a closed cross-section except for the through-holes 27 through which hydrogen jets 31 pass rather than through porous wall sections 12 as shown in FIG. 7. The air flows from left-to-right through the passages between the channels 26 held apart by the spacers 26B. A gap grid structure is formed for example of heat resistant sheet metal strips 28 interconnected by connector elements not shown. These connector elements hold the grid forming strips 28 spaced from each other in such positions that the ridges 26A are aligned with gaps between neighboring strips 28 as seen in FIGS. 18 and 19. The strips 28 are provided with cut-outs 29 best seen in FIG. 18. The sheet metal strips 28 with the cut-outs 29 are so arranged between two hydrogen distribution channels 26 that the through-holes 27 in the slanting wall portions forming the roof with the ridge 26A align with the cut-outs 29. The arrangement is such that the through-holes 27 in one slanting wall portion are staggered relative to the holes in the opposite slanting wall portion of the channels 26. Similarly, the cut-outs 29 and the intermediate lands between the cut-outs 29 in one strip 28 are staggered relative to the lands in a neighboring strip 28 so that lands in one strip face cut-outs in the other strip and vice versa as seen in FIG. 18. The hydrogen distribution channels 26 and the strips 28 are preferably so oriented relative to each other that each through hole 27 registers with one cut-out 29. However, instead of aligning just one through-hole 27, several such holes 27 of small diameter and arranged close to each other may be aligned with one cut-out 29 to feed hydrogen jets 31 through the cut-outs 29 for micromixing with air also flowing through these cut-outs 29 as shown by the air jets representing arrows 30 and the hydrogen jets representing arrows 31 in FIG. 19.

As shown in FIG. 19, the $H_2$ jets 31 extend at an angle of about 45° across the air flow direction 30. However, the crossing angle may be varied by shifting the strips 28 to the left or right as shown by the arrow 28A in FIG. 19 for optimizing the micromixing intensity. FIG. 19 shows the gap strips 28 positioned just downstream of the roof section 26A. By shifting the strips 28 slightly to the left the strips 28 would be positioned just upstream of the through-holes 27 as shown by the dashed line 28B. In any position of the strips 28, the cut-outs 29 determine the air flow direction 30 which may be selected to extend parallel to the primary flow direction in FIG. 19 by respectively adjusting the position of the strips 28 with the adjustment mechanism 28A which as such may be conventional. Similarly, the angle of the roof section 26A which is shown to be about 90° in FIG. 19 may be varied to optimize the $H_2$-air-mixing rate. The through-holes 27 may be positioned in the side walls of the channels 26 close to 28B in FIG. 19 for ejecting the hydrogen jets 31 in a direction perpendicular or at 90° to the primary air flow direction.

In order to operate the combustor 1C, air is caused to flow from left-to-right through the spaces between the channels 26 and through the cut-outs 29 as indicated by the arrows 30 thereby forming a large number of micromix air jets. Simultaneously, hydrogen passes through the through-holes 27 as indicated by the arrows 31. In this arrangement an air environment is formed in the combustion chamber CC and diffusive microcombustion flames are formed around the through-holes 27. The respective diffusive microcombustion flames stabilize themselves at the through-holes 27 and thereby each flame remains distinct from any other diffusive microcombustion flame on the burner surface.

Figure 21:
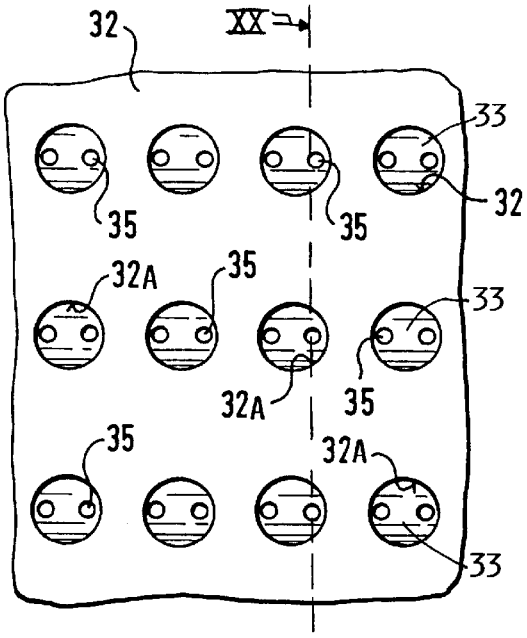
FIG. 21 is a view in the direction of the arrow XXI in FIG. 20.
Figure 20:
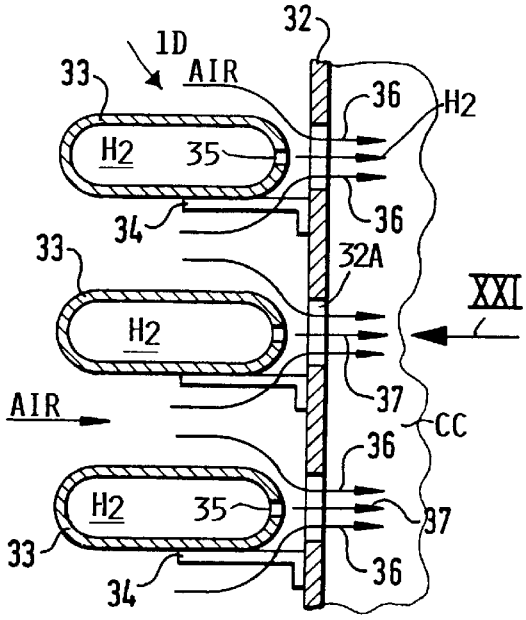
FIG. 20 is a sectional view along section line XX—XX in FIG. 21 illustrating a further embodiment of the present hydrogen combustor with a plurality of hydrogen supply channels with rounded side walls and a multitude of hydrogen distribution holes in one rounded side wall facing the combustion chamber.

FIGS. 20 and 21 show a further embodiment of a present burner 1D with a perforated plate or wall 32 preferably formed as a single wall section with apertures 32A therein. A plurality of hydrogen supply channels 33 are secured to the apertured plate 32 by brackets 34. A combustion chamber facing side wall of each channel 33 is provided with hydrogen discharge holes 35 and the channels 33 are aligned with the holes 32A in the wall 32 so that the hydrogen discharge holes 35 register with the holes 32A. The channels 33 have an elongated cross-section with rounded side surfaces, one of which is provided with the hydrogen exit holes 35 facing the combustion chamber CC. A multitude of such holes 35 is provided and FIG. 21 illustrates that at least two hydrogen exit holes 35 are aligned with each hole 32A in the wall 32. Hydrogen is discharged as indicated by the arrow 37 while air is discharged as indicated by the arrows 36 shown in FIG. 20, whereby again a very efficient and thorough micromixing of air and hydrogen is achieved in the required number of diffusive microcombustion flames.

In order to operate the burner 1D, air is caused to flow from left-to-right past the channels 33 to pass through the large number of holes 32A into the combustion chamber CC, whereby an air environment is formed inside the combustion chamber into which the hydrogen is blown as indicated by the arrows 37 to generate a multitude of diffusive microcombustion flames in the vicinity of each of the holes 35 around which the flames stabilize themselves once ignition has occurred.

Figure 22:
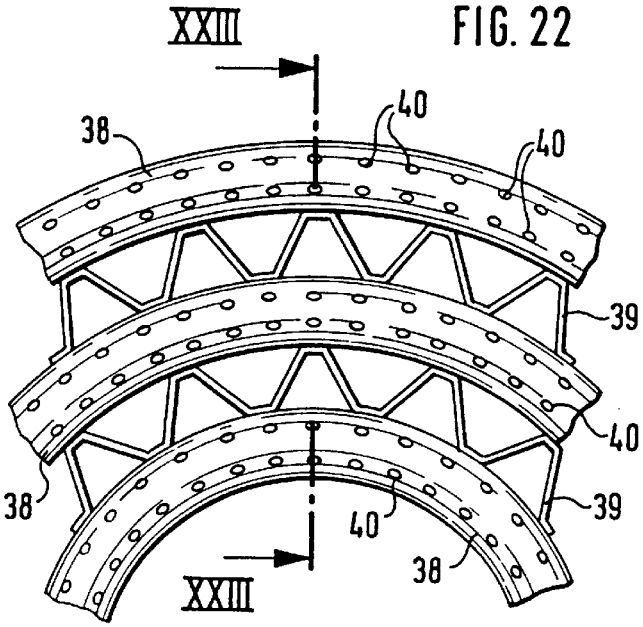
FIG. 22 is a front view in the direction of the arrow XXII in FIG. 23 illustrating yet another embodiment with circular hydrogen supply channels each having a multitude of hydrogen distribution holes in a rounded side wall facing the combustion chamber.
Figure 23:
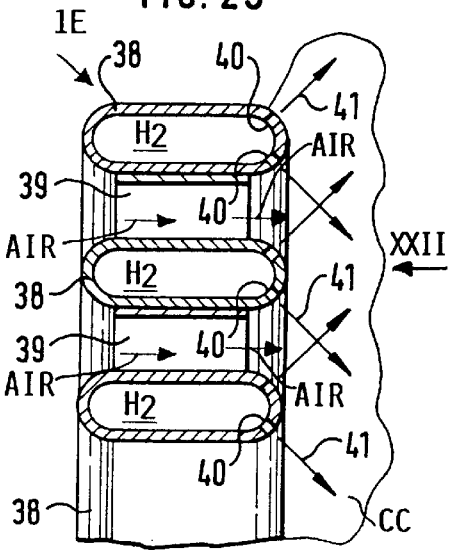
FIG. 23 is a sectional view along section line XXIII—XXIII in FIG. 22.

FIGS. 22 and 23 show another embodiment of a burner 1E according to the invention similar to that of FIGS. 20 and 21, except that the channels 38 for the hydrogen supply in the burner 1E are circular or semicircular. The cross-section of the channels 38 is substantially the same as in FIG. 20, except that the hydrogen exit holes 40 are positioned at an angle relative to a horizontal plane as shown by the hydrogen arrows 41. Preferably, each supply channel 38 forms a closed ring of radially inwardly progressively smaller diameter. These rings are mounted together by corrugated spacer strips 39, for example welded to the ring channel 38. These spacer strips 39 permit the free passage of the air through the spaces between neighboring rings 38.

It is possible to form the hydrogen supply channels 38 and the spacer strips 39 of a material that will permit winding these elements into a flat coil to form a disk-shaped or ring-shaped burner 1E. Such a coil would have a spiral shape. In both instances a multitude of holes 40 is positioned to face into the combustion chamber CC in an angular direction whereby two hydrogen jets cross each other as indicated by the arrows 41, except for the upwardly facing hole 40 in the outer ring channel 38 and the downwardly facing hole 40 in the inner ring channel 38. The ring channels and the spirally wound ring channels have a curved shape as shown. Both embodiments operate in the same manner with the same effect as described above in connection with FIGS. 18 to 21.

The burners IC and ID as shown in FIGS. 18 to 21 may easily be varied to accept circular configurations similar to the burner IE shown in FIGS. 22 and 23, if such a design better fits the gas turbine interface conditions, for example.

The present miniaturization finds the lower limit of the number of diffusive microcombustion flames per square inch of burner surface area facing into the combustion chamber at a point where a significant drop in the $NO_x$ production occurs as explained above with reference to FIG. 24. A practical lower number of such flames may require at least 10 diffusive microcombustion flames per square inch of burner surface facing into the combustion chamber CC. Preferably at least 20 such flames per square inch should be provided. The upper limit of several thousand diffusive microcombustion flames distributed over the entire available burner surface facing into the combustion chamber is reached on the one hand when the miniaturization is no longer economically feasible, or technically when the diffusive microcombustion flames are no longer stable due to the high number of flames per square inch.

Although the invention has been described with reference to specific example embodiments, it will be appreciated that it is intended to cover all modifications and equivalents within the scope of the appended claims.

What is claimed is:

1. A combustor for diffusion combustion of hydrogen fuel and air as an oxidizer in a combustion chamber in which exhaust gas including nitrogen oxides $NO_x$ is produced during combustion, said combustor comprising a burner surface area facing into said combustion chamber (CC), a number of hydrogen fuel inlet through-holes in said combustor for feeding a corresponding number of hydrogen jets (31) into said combustion chamber, a number of air inlets in said combustor for feeding air streams (30) into said combustion chamber, said hydrogen fuel inlet through-holes and said air inlets being so positioned relative to each other and relative to said combustion chamber that stable and distinct diffusive microcombustion flames are formed in said combustion chamber by diffusion micromixing hydrogen jet and air jets with a mixing intensity that depends on a pressure drop available in said combustion chamber to sustain a multitude of said stable and distinct diffusive microcombustion flames for maintaining said nitrogen oxides $NO_x$ at most at a level of $10\times10^{-6}$ cubic foot of $NO_x$ per cubic foot of said exhaust gases during combustion as measured at atmospheric burner entrance conditions, said combustor further comprising a plurality of hydrogen distribution channels (26) with air flow spaces between said channels, channel walls enclosing each of said hydrogen distribution channels, said channel walls including wall sections forming at least part of said burner surface area facing into said combustion chamber (CC), said through-holes (27) formed in said wall sections for feeding hydrogen jets (31) through said through-holes (27) into said combustion chamber (CC), said through-holes (27) extending through said wall sections so that a hydrogen flow direction of said hydrogen jets (31) extends at a first angle to a surface of said wall sections, and a grid structure (28) with cut-outs (29) in said grid structure (28) for controlling an air flow direction (30) of said air jets (30) passing through said grid structure (28), said grid structure (28) being so positioned relative to said through-holes (27) that said air jets (30) passing through said cut-outs (29) and said hydrogen jets (31) passing through said through-holes (27) cross one another at a second angle to form said stable and distinct diffusive microcombustion flames.

2. The combustor of claim 1, wherein two of said wall sections of said channel walls form a roof with a ridge (26A), and wherein said grid structure (28) is positioned downstream of said wall sections of said channel walls.

3. The combustor of claim 1, wherein said grid structure (28) is positioned upstream of said ridge forming side wall sections (26A).

4. The combustor of claim 1, further comprising position adjustment means (28A) connected to said grid structure (28) for moving said grid structure back and forth between an upstream position (28) and a downstream position (28B).

5. The combustor of claim 1, wherein said ridge forming side wall sections (26A) carry two rows of said through-holes (27) in such positions that the through-holes in one wall section are staggered relative to the through-holes in the opposite wall section, and wherein said grid structure (28) comprises a plurality of grid strips having cut-outs (29) cut into said grid strips (28A) along opposite edges of said grid strips, said cut-outs (29) being aligned with said through-holes (27).

6. The combustor of claim 1, wherein said diffusive microcombustion flames have a diameter of 2 mm at the most.

7. The combustor of claim 1, wherein said through-holes (27) are positioned on the side walls of the hydrogen distribution channels (26) close to a position (28B) for ejecting hydrogen in a direction perpendicular to the primary flow direction.

8. The combustor of claim 1, wherein said hydrogen distribution channels (26, 38) have a circular shape.

* * * * *

UNITED STATES PATENT AND TRADEMARK OFFICE

CERTIFICATE OF CORRECTION

PATENT NO. : 6,267,585 B1
DATED : July 31, 2001
INVENTOR(S) : Suttrop

It is certified that error appears in the above-identified patent and that said Letters Patent is hereby corrected as shown below:

Title page,
Item [63], insert the following item:
[30] Foreign Application Priority Data
Dec. 19, 1995 (DE).....195 47 506.2;

Item [56], OTHER PUBLICATIONS, line 5, replace "Fulled" by -- Fueled --;
Item [57], ABSTRACT, line 8, after "high", replace "nixing" by -- mixing --;
line 9, replace "micorcombustion" by -- microcombustion --;

Column 13,
Line 33, after "airstream at", replace "an" by -- a mixing --;

Column 15,
Line 37, after "ring", replace "channel" by -- channels --.

Signed and Sealed this

Nineteenth Day of March, 2002

*Attest:*

*Attesting Officer*

JAMES E. ROGAN
*Director of the United States Patent and Trademark Office*